United States Patent [19]

Schmid

[11] Patent Number: 4,708,102

[45] Date of Patent: Nov. 24, 1987

[54] ROLLER CAM FOLLOWER WITH POSITIVE LUBRICATION

[75] Inventor: Karl J. Schmid, Chicago, Ill.

[73] Assignee: Navistar International Transportation Corp., Chicago, Ill.

[21] Appl. No.: 904,723

[22] Filed: Sep. 8, 1986

[51] Int. Cl.[4] ..... F01M 9/10

[52] U.S. Cl. ..... 123/90.35; 123/90.5

[58] Field of Search ..... 123/90.5, 90.35, 90.55

[56] References Cited

U.S. PATENT DOCUMENTS

| | | | |
|---|---|---|---|
| 1,000,722 | 8/1911 | Danner | 123/90.35 |
| 1,210,871 | 1/1917 | Suffa | 123/90.35 |
| 1,565,223 | 12/1925 | Church | 123/90.5 |
| 1,835,622 | 12/1931 | Willgoos | 123/90.35 |
| 1,968,982 | 8/1934 | Barnaby et al. | 123/90.35 |
| 2,346,737 | 4/1944 | Essl | 123/90.5 |
| 3,176,669 | 4/1965 | Kuchen et al. | 123/90.35 |
| 3,314,303 | 4/1967 | Maat | 123/90.5 |
| 3,967,602 | 7/1976 | Brown | 123/90.55 |
| 4,361,120 | 11/1982 | Kueny | 123/90.55 |

*Primary Examiner*—Ira S. Lazarus

*Attorney, Agent, or Firm*—F. David AuBuchon; Dennis K. Sullivan

[57] ABSTRACT

A hydraulic roller cam follower for an internal combustion engine having an integral cylindrical body including an annular oil receiving exterior groove for receiving oil from the engine oil supply and an enclosed recess opening in the lower end including spaced sidewalls, and a roller having a central bore mounted by a pin extending into the sidewalls of the recess wherein a lubricating oil passage extends through the body from the annular groove through the sidewall and into the recess having an outlet disposed to direct a supply of pressurized lubricating oil to the entrance of the roller bore.

2 Claims, 1 Drawing Figure

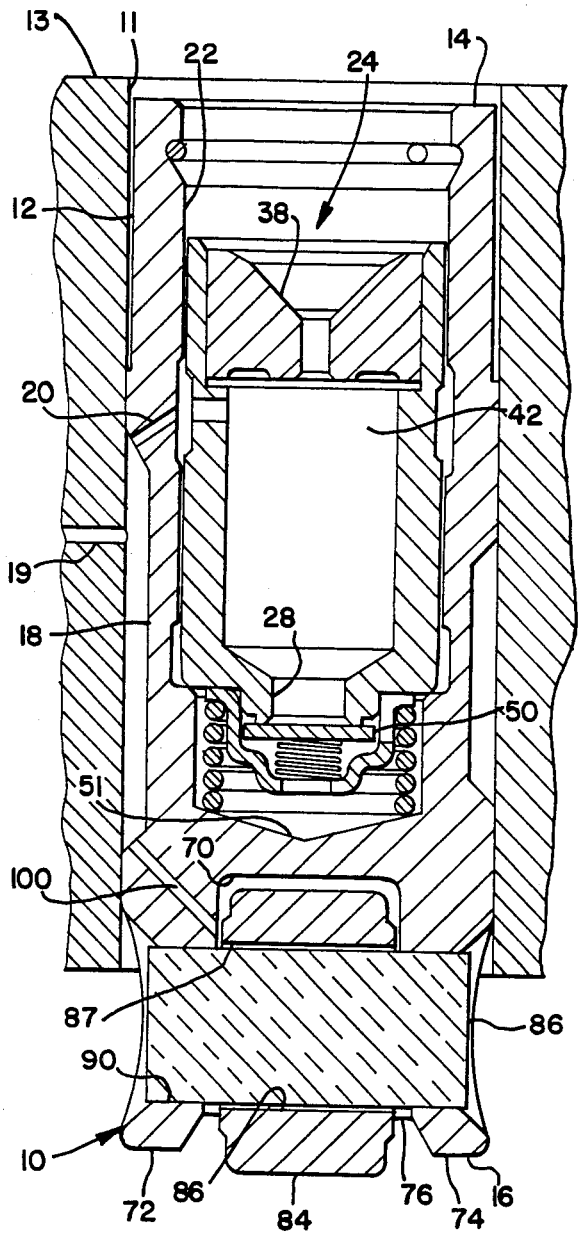
13
11
22
24
14
12
38
20
42
19
18
28
50
51
70
100
87
86
90
10
72
86
84
76
74
16

ROLLER CAM FOLLOWER WITH POSITIVE LUBRICATION

BACKGROUND OF THE INVENTION

This invention relates to roller tappets or cam followers of the type used in some internal combustion engines and, more particularly, to an improved roller follower having positive means for lubricating the roller.

Roller followers are typically used in diesel engines or in high performance engines in place of conventional tappets to provide improved engine breathing by allowing increased valve lift velocity without increasing the tappet body diameter. In U.S. Pat. No. 4,361,120, a hydraulic roller follower is described wherein a recess is provided at the lower end of the follower which substantially encloses a roller rotatably mounted therein on a pin except for a small amount of the lower roller periphery to permit contact with the engine cam. Although this design is said to be an improvement over previous roller followers by providing additional strength in the lower end, it accentuates the problems caused by poor lubrication between the roller and the pin forming its rotational axis. Lubrication of roller cam followers, including the foregoing described follower has previously depended on splash or leaking of oil through the tappet bore of the crankcase. Poor lubrication between the cam follower roller and its mounting pin leads to reduced life of the bearing surfaces and eventual seizure of the roller on the pin and failure of the camshaft lobe due to increased wear.

SUMMARY OF THE INVENTION

Accordingly, it is a primary object of the invention described and claimed herein to provide an improved roller follower of the type described wherein positive lubrication is supplied to the roller. A more specific object of the invention is to provide a directed jet of lubricant to the roller bore to provide lubrication between the roller and its mounting pin.

These and other objects as will hereafter be seen are specifically met in a hydraulic roller cam follower for an internal combustion engine having an integral cylindrical body including an annular oil receiving exterior groove for receiving oil from the engine oil supply and an enclosed recess opening in the lower end including spaced sidewalls, and a roller having a central bore mounted on a pin extending into the sidewalls of the recess wherein a lubricating oil passage extends through the body from the annular groove through the sidewall and into the recess having an outlet disposed to direct a supply of pressurized lubricating oil to the entrance of the roller bore. In addition to providing increased lubrication of the bearing surfaces between the pin and roller, additional lubricant for dripping on the cam surfaces of the camshaft will be provided.

BRIEF DESCRIPTION OF THE DRAWING

The drawing is a side elevation sectional view with a roller cam follower in accordance with the present invention disposed in a tappet bore.

DETAILED DESCRIPTION OF THE PREFERRED EMBODIMENT

Referring to the drawing, a roller cam follower or tappet generally designated 10 is disposed in bore 11 of engine crankcase 13 for reciprocation therein by a cam (not shown) disposed therebeneath to actuate the engine valve mechanism through a conventional push rod (not shown). The general design of the cam follower 10 is a hydraulic cam follower generally in accordance with that described in the aforementioned U.S. Pat. No. 4,361,120, which is incorporated by reference herein, and includes an elongated generally cylindrical body 12 having an upper end 14 and a lower end 16. The body 12 includes an exterior annular oil receiving groove 18 which receives oil from port 19 connected to the positive pressure side of the engine oil lubricating system and extending into the bore 11. An oil input port 20 extends through the wall of body 12 into a longitudinally extending central chamber 22 therein opening through the upper end 14 thereof. Slideably disposed within chamber 22 is a plunger assembly generally designated 24 providing a seat 38 for the push rod and an oil reservoir 42. A port 28 at the bottom of the reservoir 42 is enclosed by valve 50 from lower chamber 51. It can be seen that when oil is supplied through engine port 19 and input port 20 into reservoir 42, the engine oil pressure will open the valve 50 and fill the lower chamber 51 pumping up the plunger assembly 24 until the hydraulic pressure biases the entire assembly against the valve train as is conventional.

The lower end 16 of the body 12 defines an elongated, longitudinally extending enclosed recess 70 opening therethrough but separated from the chamber 22. Recess 70 includes opposed spaced generally parallel sidewalls 72, 74 joining opposed end walls, one of which being partially shown at 76. Rotatably disposed within the recess 70 and substantially enclosed thereby is roller 84 which has a central bore 86. Extending through the central bore 86 is a roller pin 88 which extends into the sidewalls 72, 74 of the body 12 in transverse bore 90 and is press fit or staked therein. The roller pin 88 is preferably a bronze pin operating directly against the central bore to form a journal bearing. As can be seen from the drawing, the roller is substantially enclosed by the tappet body and only a small arc of the outer periphery of the roller extends from the recess formed in the body while providing sufficient clearance between the body and the cam surface for engagement of the roller 84 therewith. Further details may be had by reference to U.S. Pat. No. 4,361,120.

In accordance with the invention, a passage means for supplying oil under pressure from the annular groove 18 to the roller 84 is provided in the form of passage 100 which communicates with the lower portion of annular groove 18 through the sidewall 72 of the lower portion 16 of the body 12 and into the recess 70 directly above pin 88 and adjacent the entrance 87 to the central bore 86 of roller 84. The size of passage 100 is relatively small, on the order of 0.5 mm, to provide a directed stream of lubricating oil into the entrance to bore 86. Since the clearance between the bore 86 and pin 88 occurs mainly on top of pin 88 when the cam follower is loaded, the pressurized oil will squirt down the clearance to the other end of bore 86 thus lubricating the entire bore. It will be appreciated that a second passage 100 could be drilled from the annular groove to the opposite entrance to the roller bearing bore if desired. However, this has not been found to be necessary. Addition of the positive lubrication system in accordance with the invention has been found to greatly extend the bearing life of the journal bearing surfaces between the roller and the pin.

Although the present invention has been described in connection with a specific embodiment, the spirit and scope of the appended claims should not necessarily be limited to the foregoing description. For example, although the invention has been described in connection with a hydraulic cam follower and is most economically utilized therewith, since the port 19 in the crankcase and the annular groove 18 in the cam follower body already exist, the invention could be embodied in a nonhydraulic roller cam follower. Similarly, although taught in connection with a fully enclosed recess at the bottom of the cam follower body, the invention could also be used where the recess is not enclosed but is merely defined by the spaced bifurcated sidewalls which support the pin.

What is claimed is:

1. In a roller cam follower of the type adapted to be reciprocated within a bore of an internal combustion engine, said engine bore including a port operatively associated with a source of pressurized engine lubricating oil, said roller cam follower including an integral cylindrical body having an upper end and a lower end and an annular oil receiving exterior groove operatively associated with said engine bore port, and an enclosed recess opening through the lower end of said body including spaced side walls, a roller having a central bore disposed substantially within said recess with only a small portion of the roller extending therefrom adapted to engage a cam, and a pin having a continuous cylindrical surface extending through said roller bore and into the side walls of said recess for journally mounting said roller, the improvement comprising a passage extending from said oil receiving groove through said side wall and into said recess above said pin, said passage being sufficiently small and disposed in said recess to direct a stream of pressurized lubricating oil into an entrance to said roller bore.

2. A roller cam follower of the type adapted to be reciprocated within a bore of an internal combustion engine by a cam, said bore including a port operatively associated with a source of pressurized engine lubricating oil, said roller cam follower including an integral cylindrical body having an upper end and a lower end facing the cam, an annular oil receiving exterior groove disposed between said upper and lower ends of said body and operatively associated with said engine bore port, a central chamber opening through said upper end, a plunger reciprocal within said central chamber, said plunger defining an oil reservoir in fluid communication with said annular groove, a recess opening through said lower end of said body and defined by spaced side walls, a roller having a central bore, and a pin having a continuous cylindrical surface extending through said roller bore and into said side walls of said recess of said body for rotatably mounting said roller to said body primarily within said recess, the improvement comprising a passage extending from said oil receiving groove through one of said side walls to an outlet in said recess adjacent to an entrance to said roller bore, said passage and said outlet being disposed to direct a pressurized stream of lubricating oil at the intersection of said pin and said entrance to said roller bore.

* * * * *